US005908002A

United States Patent [19]

Alexander et al.

[11] Patent Number: 5,908,002

[45] Date of Patent: Jun. 1, 1999

[54] TABLE WITH ARTICLE-SUPPORTIVE SURROUND

[75] Inventors: Brian D. T. Alexander, Douglas; Roque Matias Corpuz, Jr., Grand Rapids, both of Mich.

[73] Assignee: Haworth, Inc., Holland, Mich.

[21] Appl. No.: 08/870,954

[22] Filed: Jun. 6, 1997

[51] Int. Cl.[6] ..... A47B 35/00

[52] U.S. Cl. ..... 108/50.11; 108/50.01; 108/92

[58] Field of Search ..... 108/27, 60, 61, 108/50.11, 50.01, 50.02, 92; 211/55, 128.1

[56] References Cited

U.S. PATENT DOCUMENTS

| | | | |
|---|---|---|---|
| D. 286,233 | 10/1986 | Schreiner . | |
| D. 321,447 | 11/1991 | Newhouse . | |
| D. 370,571 | 6/1996 | Newhouse et al. . | |
| D. 377,873 | 2/1997 | Floetotto . | |
| D. 388,981 | 1/1998 | Gongora et al. . | |
| D. 389,336 | 1/1998 | Moore . | |
| D. 389,667 | 1/1998 | Moore . | |
| 581,127 | 4/1897 | McCorkle . | |
| 1,528,855 | 3/1925 | Smith . | |
| 1,911,959 | 5/1933 | Kern et al. . | |
| 2,090,176 | 8/1937 | Besancon . | |
| 2,153,422 | 4/1939 | Kroman . | |
| 2,305,244 | 12/1942 | Erickson | 108/27 X |
| 2,520,490 | 8/1950 | Boward . | |
| 3,160,283 | 12/1964 | Lachance | 108/27 X |
| 3,464,372 | 9/1969 | Fiterman et al. | 108/60 |
| 4,605,988 | 8/1986 | Nienhuis et al. . | |
| 4,852,500 | 8/1989 | Ryburg et al. . | |
| 4,914,873 | 4/1990 | Newhouse . | |
| 4,938,366 | 7/1990 | Carroll . | |
| 5,009,335 | 4/1991 | Jonker . | |
| 5,024,167 | 6/1991 | Hayward . | |
| 5,120,117 | 6/1992 | Williams . | |
| 5,289,926 | 3/1994 | Lewis et al. . | |
| 5,317,977 | 6/1994 | Omessi . | |
| 5,357,873 | 10/1994 | Hilton | 108/50.01 |
| 5,473,994 | 12/1995 | Foley et al. | 108/50.02 |
| 5,609,112 | 3/1997 | Meyer et al. . | |
| 5,673,632 | 10/1997 | Sykes | 108/50.02 X |
| 5,694,862 | 12/1997 | Grubb | 108/50.01 |

FOREIGN PATENT DOCUMENTS

| | | |
|---|---|---|
| 1 221 737 | 6/1960 | France . |
| 92 04 035 | 6/1992 | Germany . |
| 2 204 479 | 11/1988 | United Kingdom . |

OTHER PUBLICATIONS

US Ser. No. 29/071,761, filed Jun. 6, 1997.
US Ser. No. 08/890914, filed Jul. 10, 1997.
US Ser. No. 29/073261, filed Oct. 28, 1997.
US Provisional No. 60/019407, filed Jun. 7, 1996.
US Ser. No. 60/019425, filed Jun. 7, 1996.
PCT/US97?10701, filed Jun. 5, 1997.
PCT/US97/10572, filed Jun. 5, 1997.
US Ser. No. 08/870789, filed Jun. 6, 1997.
US Ser. No. 29/071758, filed Jun. 6, 1997.
Seven sheets of drawings from copending Serial No. 08/870 789 filed Jun. 6, 1997.
Ten sheets of drawings from copending Serial No. 08/890 914 filed Jul. 10, 1997.
Four sheets of drawings from provisional Serial No. 60/019 407 filed Jun. 7, 1997.

*Primary Examiner*—José V. Chen
*Attorney, Agent, or Firm*—Flynn, Thiel, Boutell & Tanis, P.C.

[57] ABSTRACT

A table for use in an office-type environment includes a height-adjustable work surface and an article-supportive surround which extends upwardly from a rear edge of the work surface. The work surface is horizontally enlarged and slopes upwardly away from the front edge thereof to facilitate the storage and organization of documents. Also, the article-supportive surround is formed from three vertically adjacent but horizontally offset shelves which provide additional area for the storage of documents in a readily viewable upright position.

20 Claims, 5 Drawing Sheets

TABLE WITH ARTICLE-SUPPORTIVE SURROUND

FIELD OF THE INVENTION

The invention relates to a table for use in an office-type environment and more particularly, to a table having an article-supportive surround which extends upwardly from a work surface to provide an increased surface display area, both vertically and horizontally, for displaying and accessing documents.

BACKGROUND OF THE INVENTION

Most offices include conventional work surfaces such as tables and desks for supporting papers and the like as they are being used. However, for jobs or projects which have a large volume of papers, conventional work surfaces typically provide limited table or desk top space. This limited space can make it more difficult to manage or control a large amount of papers or documents as they are being used. More specifically, the worker typically has a limited amount of space in which to spread out and display the documents which can make it more difficult to sort and organize the documents. Further, even when the documents are spread out on the work surface, those documents that are stored in the areas of the work surface located farthest away from the worker typically are more difficult to access and view.

It is an object of the invention, therefore, to provide a work station which overcomes many of the difficulties of conventional work surfaces associated with displaying and accessing documents thereon.

This invention relates to a table having an increased surface display area which facilitates the display and organization of the documents being used by a worker, i.e. the worker's work-in-progress. The work station of the invention includes a horizontally enlarged work surface and an article-supportive surround extending upwardly therefrom which more effectively displays the work-in-progress.

More particularly, the work surface is horizontally enlarged so as to provide an area for writing and supporting documents thereon. Preferably, the work surface slopes upwardly away from the user seated at the table so as to store documents thereon at an inclined angle which makes it easier to review and locate the documents.

The article-supportive surround extends sidewardly along the entire back edge of the work surface, and extends upwardly therefrom. In particular, the article-supportive surround defines a plurality and preferably three shelves which are vertically joined together but are horizontally offset. Each shelf includes a bottom wall which extends generally rearwardly and an upright wall which extends upwardly at an inclined angle so as to store papers in an upwardly inclined position. Thus, documents can be readily stored on the shelves.

The article-supportive surround preferably is formed of a rigid open frame connected to the work surface and a flexible mesh or screen which covers the frame and defines the bottom and upright walls of the shelves. The screen not only is light in weight but also facilitates the flow of air and light therethrough.

Accordingly, with this table, a worker can work thereat while being able to readily store, see and access documents located either on the work surface or the article-supportive surround. The table thereby makes it easier for a worker to organize his or her work-in-progress.

Other objects and purposes of the invention, and variations thereof, will be apparent upon reading the following specification and inspecting the accompanying drawings.

Figure 1:
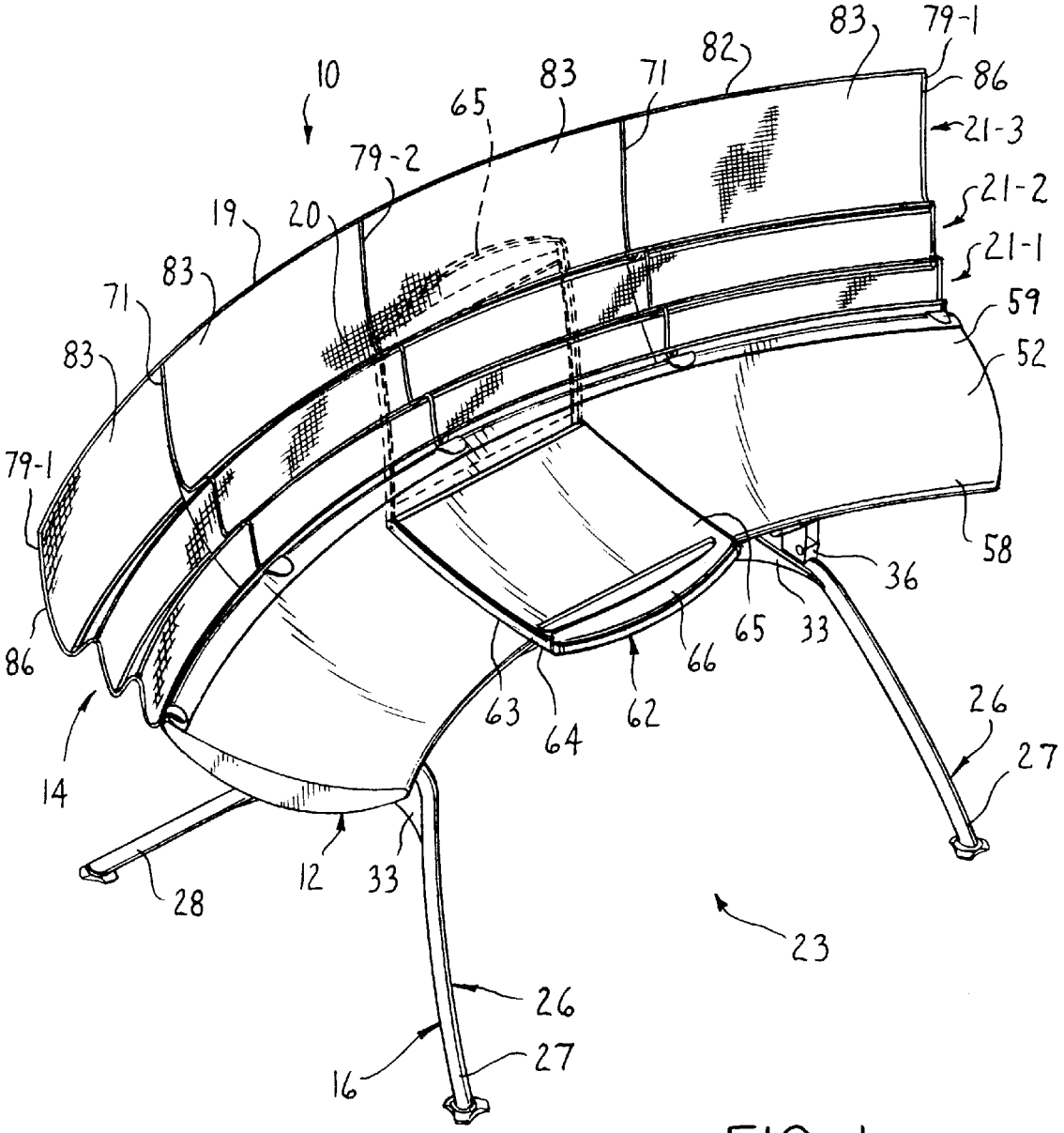
FIG. 1 is a front isometric view of a table according to the present invention having an article-supportive surround extending upwardly therefrom.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIG. 1, the invention relates to a table 10 having a horizontally enlarged work surface 12 and an article-supportive surround 14 which is connected to the work surface 12 along a rear edge thereof and projects upwardly therefrom for the storage of papers, documents and other related articles.

Generally, the table 10 includes a support frame 16 which supports the work surface 12 vertically above the floor. The work surface 12 is connected to the support frame 16 by vertically adjustable arm assemblies 17 (FIGS. 2 and 5) to permit adjustment of the height of the work surface 12. To facilitate organization of work-in-progress, the article-supportive surround 14 extends upwardly from the work surface 12. The surround 14 includes a rigid open frame 19 connected to the work surface 12 and a wire mesh or screen 20 which is supported by the open frame 19 and preferably defines a plurality of vertically staggered shelves 21-1, 21-2 and 21-3 that are adapted to support documents and other articles thereon.

Figure 2:
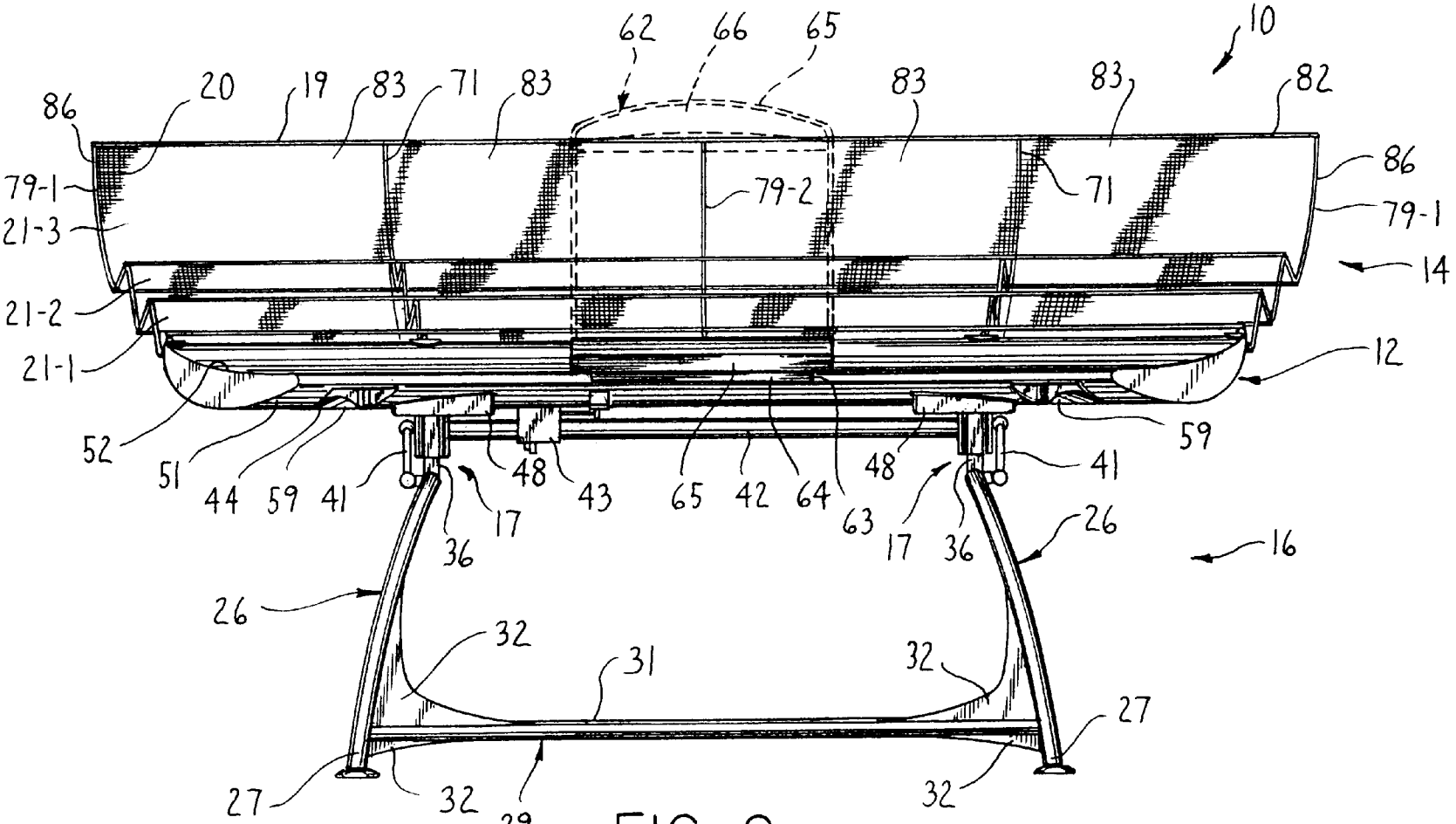
FIG. 2 is a front elevational view of the table.
Figure 4:
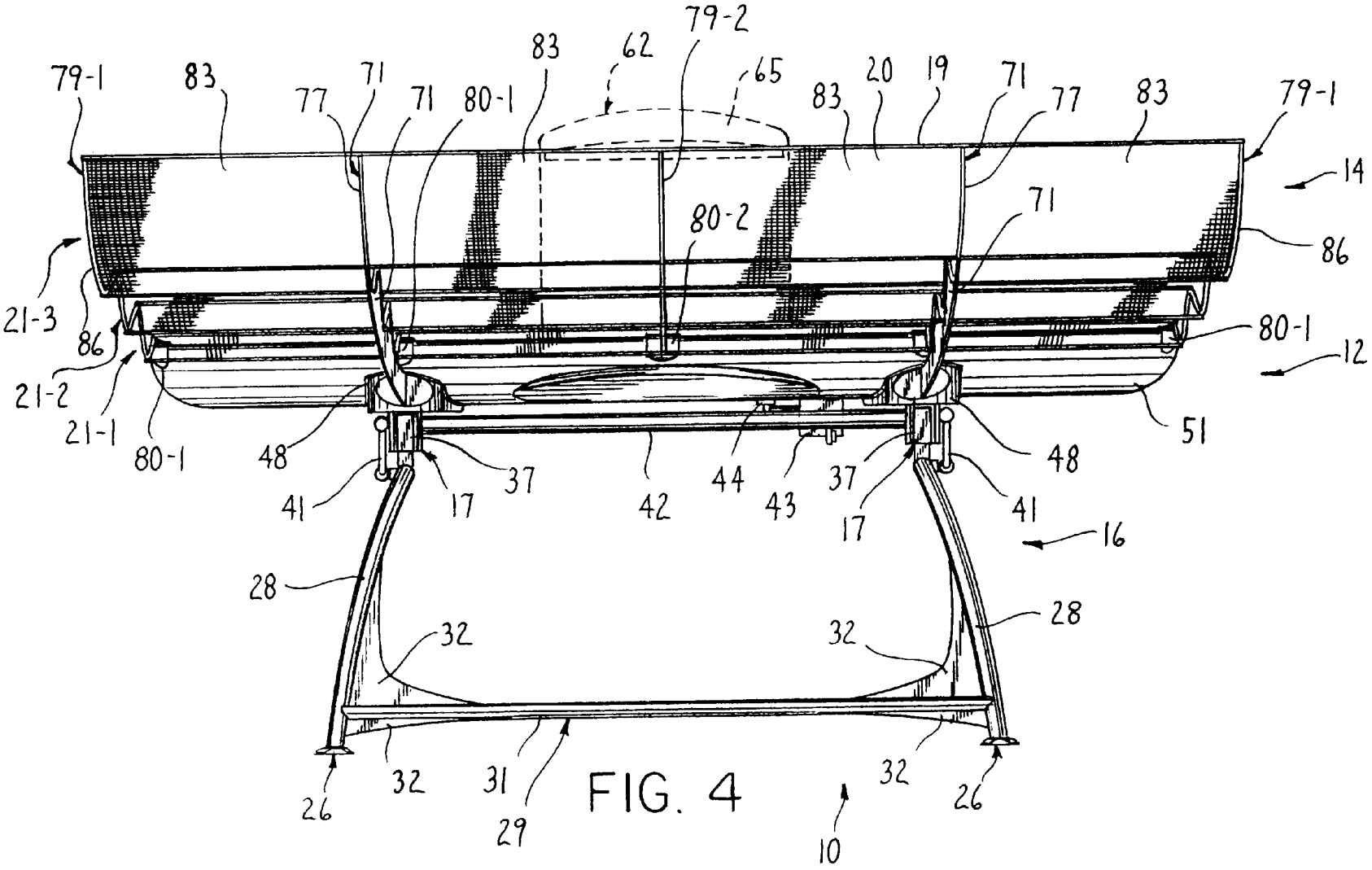
FIG. 4 is a rear elevational view of the table.
Figure 5:
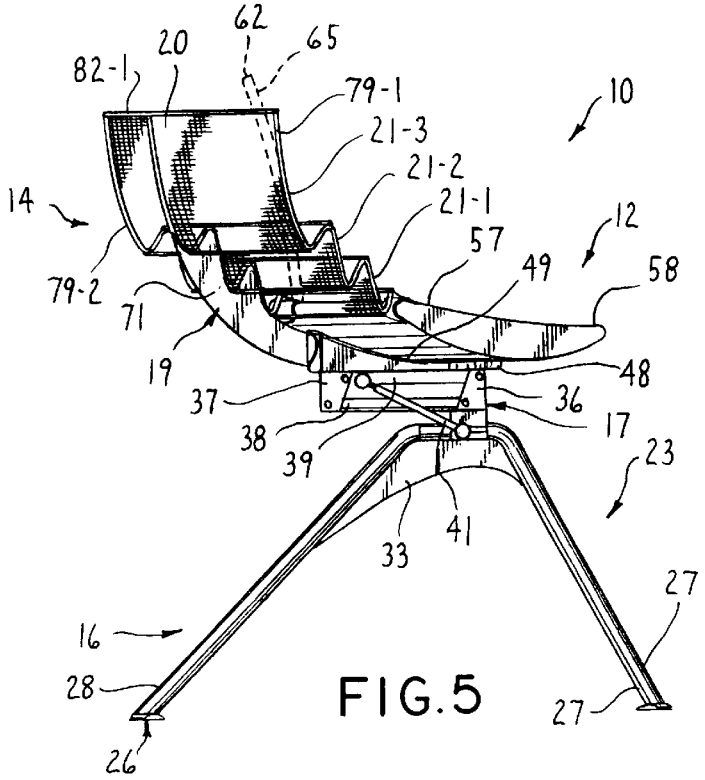
FIG. 5 is a side elevational view of the table.

More particularly with respect to the components of the table 10, the support frame 16 is supported in load bearing relation on a floor and defines an open knee space 23 below the work surface 12 for accommodating the legs of a user therein. Referring to FIGS. 2, 4 and 5, the support frame 16 includes a pair of sidewardly or laterally spaced apart leg elements 26 which are formed of hollow tubing and are bent into a downward-opening V-shape. The downward extending free ends of the leg elements 26 define forward and rearward legs 27 and 28. As can be seen, the leg elements 26 and in particular, the front legs 27 are laterally spaced apart so as to define the knee space 23 therebetween.

Figure 3:
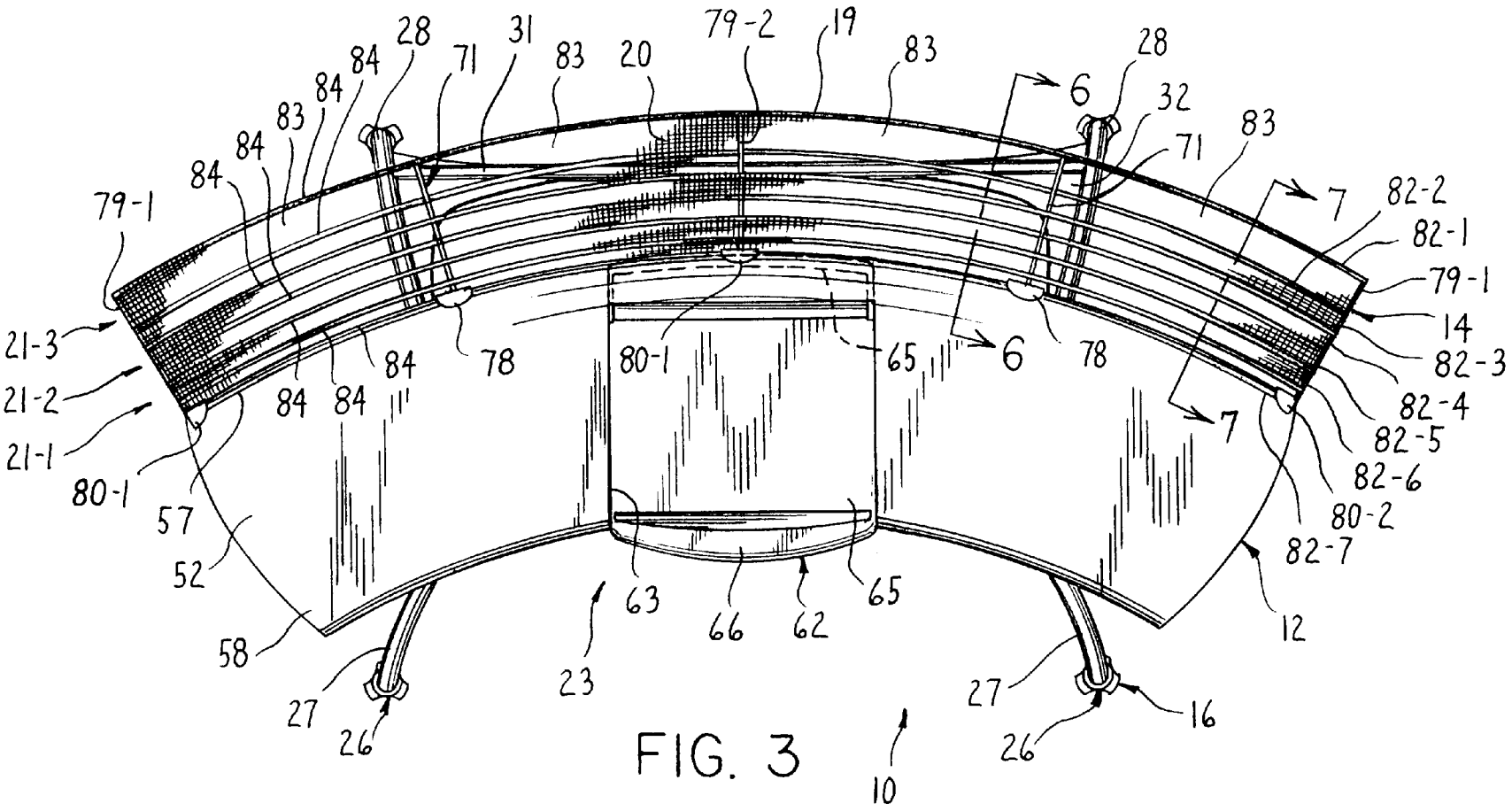
FIG. 3 is a top plan view of the table.

The leg elements 26 are joined together as a rigid structure by a horizontal frame element 29 extending laterally between the rear legs 28 as seen in FIGS. 2–4. The frame element 29 comprises a rigid cross member 31, the opposite ends of which are rigidly connected to the rear legs 28. The frame element 29 also includes rigid plate-like webbing 32 which extends vertically from the cross member 31 along the rear legs 28 to strengthen the connection between the cross member 31 and the rear legs 28.

To provide further rigidity to the support frame 16, the leg elements 26 also include plate-like side webbing 33 (FIG. 5) which rigidly joins the upper ends of the front and rear legs 27 and 28 together. In particular, the side webbing 33 is located near the apex of each of the leg elements 26.

To connect the work surface 12 to the leg elements 26, the upper end of each leg element 26 supports the vertically adjustable arm assemblies 17 thereon. In particular, the adjustable arm assemblies 17 include a lower connector bracket 36 rigidly connected to the upper ends of the leg elements 26, and an upper connector bracket 37 which is adapted to be connected to the work surface 12 as described in detail hereinafter.

The lower and upper connector brackets 36 and 37 are joined together by a pair of pivot arms 38 and 39 so that the upper connector bracket 37 is vertically movable. In particular, the opposite ends of the pivot arms 38 and 39 are pivotally connected to the lower and upper connector brackets 36 and 37 such that the pivotable connection of the pivot arms 38 and 39 to the lower and upper connector brackets 36 and 37 generally defines a parallelogram linkage.

Each of the arm assemblies 17 also includes an internal spring (not illustrated) therein that tends to bias the upper connector bracket 37 upwardly. To further assist in biasing the upper connector bracket 37 upwardly, the vertically adjustable arms 17 also include a pressure cylinder 41 which is pivotally connected between a respective leg element 26 and the pivot arm 39.

When the work surface 12 is connected thereto, the upward acting biasing forces of the internal springs (not illustrated) and the pressure cylinders 41 tend to urge the work surface 12 upwardly. When the work surface 12, however, is manually pressed downwardly by a user, the work surface 12 can be moved to a lower height due to the pivoting movement of the arms 38 and 39.

To join the vertically adjustable arms 17 together so as to act in unison, the pivot arms 39 of the two adjustable arm assemblies 17 are rigidly joined together by a rigid horizontal tube 42 which extends horizontally therebetween as seen in FIGS. 2 and 4. During vertical movement of the work surface 12, the tube 42 swings or moves with the pivot arms 39 relative to the upper connector bracket 37.

To brake or lock the arm assemblies 17 and maintain the work surface 12 at a selected height, the tube 42 is connected to a brake mechanism 43 disposed on the bottom of the work surface 12 which normally prevents movement of the tube 42 and the pivot arms 39 connected thereto, and thereby prevents vertical movement of the arm assemblies 17. The brake mechanism 43 is connected to a manually-actuatable actuator lever 44 through a coaxial cable to effect unlocking of the brake mechanism 43 and permit adjustment of the height of the work surface 12.

The particular construction of the vertically adjustable arm assembly 17, brake mechanism 43 and actuator button 44 is conventional. An example of the structure of these components is disclosed in detail in U.S. patent application Ser. No. 08/649 032, entitled KEYBOARD SUPPORT (Atty. Ref.: *Haworth* Case 190), filed May 16, 1996. The disclosure of this application is incorporated herein, in its entirety, by reference. The particular arrangement illustrated herein, however, differs in that the pressure cylinders 41 are provided in combination with the arm assemblies 17 to provide the additional lifting force.

Each of the upper connector brackets 37 is rigidly connected to a work surface support member 48 (FIGS. 2, 4 and 5) which extends forwardly therefrom in cantilevered relation and is oriented generally horizontally. The work surface support members 48 are maintained in this horizontal orientation as the work surface 12 is moved vertically since the pivot arms 38 and 39 define the parallelogram linkage which maintains the upper connector brackets 37 in a horizontal orientation.

To support the work surface 12, the work surface support members 48 have an arcuate upper surface 49 (FIG. 5) which is adapted to support a corresponding arcuate shape of the bottom surface 51 of the work surface 12. The work surface 12 thereby is supported at two locations by the work surface support members 48 and overlies the knee space 23 formed between the leg elements 26.

The work surface 12 is formed as a horizontally enlarged rigid unit, the opposite ends of which project sidewardly beyond the work surface support members 48. The work surface 12 is defined by the curved bottom surface 51 as well as a curved upper surface 52 which defines an area upon which a user can work.

Preferably, the upper surface 52 slopes upwardly as generally seen in FIG. 5 so as to be inclined at an angle. The sloping of the upper surface 52 thereby allows for the storage of papers and the like thereon at a slightly inclined angle which facilitates viewing and organizing of documents.

While the upper surface 52 inclines upwardly as it extends rearwardly toward a rear edge 57 of the work surface 12, the front edge 58 of the work surface 12 preferably is raised slightly relative to an intermediate section thereof that is disposed between the front and rear edges 58 and 57. The raised front edge 58 of the work surface 12 helps prevent writing instruments and other articles from rolling off the front of the table.

The front edge 58 also is formed with rearwardly extending and downward opening pockets 59 on the opposite ends of the work surface 12. Either the left or right pocket 59 contains the actuator lever 44 therein.

When viewed from above as seen in FIG. 3, the work surface 12 has a forwardly curving shape so as to curve toward the user. As a result, the opposite left and right ends of the work surface 12 are located closer to the worker.

To further facilitate the organization of work-in-progress, the work surface 12 preferably is provided in combination with a movable storage case 62. In particular, a central section of the upper surface 52 of the work surface 12 is formed with an upward opening recess or cavity 63 which has a rectangular shape adapted to receive the storage case 62 therein. The storage case 62 is formed of a rectangular housing 64 which is adapted to be seated in the recess 63, and a hinged cover or lid 65 which can be pivoted upwardly to the open position as generally illustrated in phantom outline in FIG. 1. The cover 65 also can be pivoted downwardly to the closed position as illustrated in solid outline in FIG. 1 such that the storage case 62 can be removed and carried by a handle 66 formed along a front edge thereof.

Preferably, the left and right side edges of the housing 64 are formed with flexible side flaps or pivotable panels (not illustrated) which are foldable outwardly onto the left and right sides of the work surface 12 when the cover 65 is in the open position. When the storage case 62 is closed, documents preferably are maintained therein in the same arrangement as they were laid out on the work surface 12 during use. Thus, the user can pack up and carry the work-in-progress in substantially the same arrangement as it was laid out on the storage case 62 during use on the work surface 12. The work surface 12, however, also is usable without the storage case 62.

To further facilitate the storage and display of work-in-progress, the article-supportive surround 14 extends sidewardly along and is connected to the rear edge 57 of the work surface 12. When viewed from above, the surround 14 has a generally arcuate shape which conforms to the arcuate shape of the rear work surface edge 57 such that articles supported on the opposite ends of the surround 14 face radially or generally towards the user located in the area in front of the work surface 12.

Generally, the surround 14 defines three tiers of shelves 21-1, 21-2 and 21-3 which extend vertically one above the other and are horizontally offset rearwardly of each other. The shelves 21-1, 21-2 and 21-3 thereby define three independently accessible tiers upon which documents can be stored in an upright position facing the user.

More particularly, the surround 14 is defined by a rigid open frame 19 which is connected to the work surface 12 and projects vertically and rearwardly away therefrom. As described in detail hereinafter, the open frame 19 includes an arrangement of vertical and horizontal elements which support the mesh screen 20 thereon to define the surfaces of the shelves 21-1 to 21-3.

Figure 6:
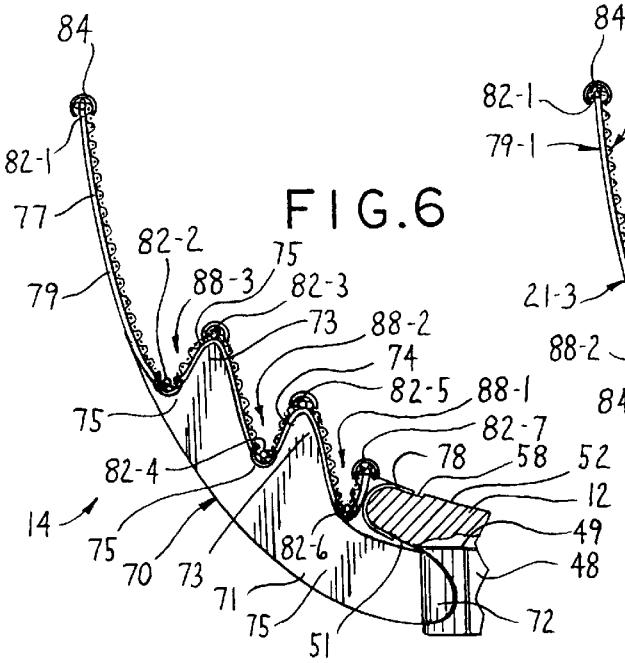
FIG. 6 is a cross-sectional view of a frame and screen of the article-supportive surround as taken along line 6—6 of FIG. 3.

With respect to the open frame 19 as seen in FIGS. 4–6, a pair of rigid upright support arms 71 curve rearwardly and upwardly away from the rear edge 57 of the work surface 12. The screen support arms 71 are formed of a rigid plate-like material and have a forward-opening C-shaped bracket 72 rigidly connected to the lower end thereof. The C-shaped bracket 72 is adapted to fit over and mate with an opposing curved surface defined by the rear edge of the work surface support members 48. Each C-shaped bracket 72 is rigidly secured to the support members 48 to rigidly support the support arms 71.

To define the side profile of the screen 20, the upper edges of the screen support arms 71 each have a sinusoidal-like shape defined by a pair of projections 73. The peak 74 of the uppermost one of the projections 73 is vertically spaced above and offset rearwardly from the peak 74 of a lowermost one of the projections 73 as seen in FIG. 6. This upper edge also curves downwardly on the opposite front and rear sides of each of the peaks 74 so as to define three upper, lower and intermediate valleys 75.

To extend the support arms 71 an additional distance upwardly and rearwardly, the support arms 71 include a rigid support rod 77 which extends upwardly to define the overall height of the surround 14. The vertical support rod 77 is mounted to the rear edge 57 of the work surface 12 by a forward-opening C-shaped clip 78 which is fastened to a lower end thereof. The clip 78 fits over and is rigidly secured to the rear work surface edge 57 such that the support rod is supported in cantilevered relation therewith.

In particular, each support rod 77 includes a lower curved section which is formed with a sinusoidal-like shape or profile which conforms to the profile of the support plate 71 and is secured thereto along the upper edge. An upper vertically elongate section of the support rod 77 continues upwardly above the upper end of the support plate 71 to define a vertical extension thereof.

Figure 7:
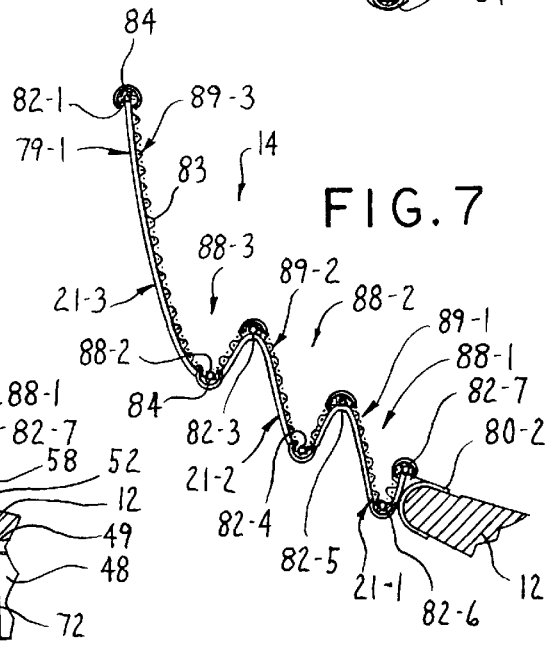
FIG. 7 is a side cross-sectional view of the article-supportive surround as taken along line 7—7 of FIG. 3

Referring to FIGS. 3, 4 and 7, the open frame 19 further includes two end support rods 79-1 which are located at the opposite ends of the open frame 19 and an intermediate support rod 79-2 which is located centrally in the region between the two screen support arms 70. The support rods 79-1 and 79-2 are rigidly connected to the rear edge 57 of the work surface 12 in cantilevered relation therewith by forward-opening C-shaped mounting clips 80-1 and 80-2 respectively which are mounted thereto substantially the same as the C-shaped brackets 72 described previously. Preferably, the intermediate clip 80-2 is formed the same as the clip 78, while the end clips 80-1 are a half section of the clips 78 and 80-2.

The support rods 79-1 and 79-2 otherwise are formed the same as the support rod 77 in that they have a sinusoidal-like shape which defines peaks 74 and valleys 75 as seen in FIG. 7.

To support the screen 20 in the regions between the screen support arms 70 and the support rods 79-1 and 79-2, the open frame 19 also includes a plurality of elongate horizontal rods 82 which are mounted to the support rods 77, 79-1 and 79-2. The horizontal rods 82 extend sidewardly between the opposite ends of the surround 14 and have an arcuate shape when viewed from above as seen in FIG. 3. The rods 82 are fixed to each of the screen support arms 70 and the support rods 79-1 and 79-2. In particular, the horizontal rods 82 are mounted to the peaks 74 or valleys 75 defined by the support rods 77 on the screen support arms 70 and the intermediate support rods 79-1 and 79-2. Thus, while the horizontal rods 82 are oriented parallel with respect to each other, each of the horizontal rods 82 is offset both vertically and horizontally relative to an adjacent one of the horizontal rods 82 as seen in FIGS. 6–8.

To define the surfaces of the shelves 21-1 to 21-3, the screen 20 is mounted to the open frame 19 as described in detail hereinafter. In particular, the screen 20 is formed of four separate rectangular screen sections 83 which are connected to the horizontal rods 82. Each screen section 83 extends horizontally or sidewardly so as to fill the space between each adjacent pair of support rods 77 and 79-1 or 79-2.

Figure 8:
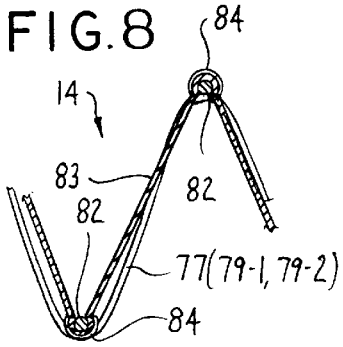
FIG. 8 is an enlarged partial view of the connection of the screen to the frame of the article-supportive surround.

The screen sections 83 are formed of a flexible mesh material such as a woven stainless steel which is deformable to allow the screen sections 83 to effectively be threaded about the horizontal rods 82 as seen in FIGS. 6–8. The mesh material is similar to the mesh used for conventional window screens but preferably has slightly larger mesh openings to facilitate the passage of air and light therethrough and permit a user to see through the material. The mesh material preferably flexes or yields somewhat or otherwise is conformable to three-dimensional irregular shaped objects which may be stored thereon. Thus, the mesh material conforms at least to a limited extent to the shape of the objects or articles. Also, it may be possible to hang articles on the mesh due to the openings provided therein.

More particularly as seen in FIGS. 6–8, to secure the screen sections 83 on the frame 19, the top or bottom of the screen section 83 is threaded or woven into and out of the areas between the horizontal rods 82. As a result, the opposite upper and lower ends of the screen sections 83 are connected respectively to the uppermost horizontal rod 82-1 and the lowermost rod 82-7. The screen sections 83 are securely connected to these horizontal rods 82-1 to 82-7 by horizontally elongate C-shaped clips 84 which are snapped over the horizontal rods 82-1 and 82-7 after a portion of the screen section 83 has been wrapped about the outer periphery thereof.

In the region between the opposite upper and lower edges of the screen sections 83, the screen section 83 has a sinusoidal-like shape wherein the horizontal rods 82-2 to

82-6 support the screen sections 83 radially outwardly thereof. The screen section 83 is connected to each of the horizontal rods 82-2 to 82-6 by additional clips 84 which are snapped over the outer periphery thereof as generally illustrated in FIGS. 7 and 8. In particular, the clips 84 are snapped from above over the rods 82-1, 82-3, 82-5 and 82-7, while additional clips 84 are snapped from below over the rods 82-2, 82-4 and 82-6. Thus, each of the screen sections 83 is rigidly connected to the horizontal rods 82-1 to 82-7 along substantially the entire horizontal length thereof. The opposite ends of the surround 14 includes additional C-shaped edge clips 86 which have a sinusoidal-like profile and are frictionally fitted over the support rods 79-1 at the end edges of the endmost screen sections 83 to provide rigid support thereto.

Accordingly, each of the shelves 21-1 to 21-3 respectively includes an upward opening horizontally elongate trough 88-1 to 88-3 (FIG. 7) which define a bottom wall thereof, and a forward facing rear wall 89-1 to 89-3 which extends upwardly from the respective troughs 88-1 to 88-3. The troughs 88-1 to 88-3 are adapted to support the lower ends of documents therein as well as additional articles. Further, the rear walls 89-1 to 89-3 preferably are inclined rearwardly at an angle such that documents stored in the troughs 88-1 to 88-3 are supported by the rear walls 89-1 to 89-3 in an inclined upright position.

Thus, documents and articles can be stored in any of the shelves 21-1 to 21-3, and due to the arcuate shape of the surround 14, typically face radially towards the user who is seated in front of the storage case 62. Further, since the shelves 21-1 to 21-3 are horizontally offset relative to each other or in other words, are vertically staggered, documents can be stored one above the other in any one or all three of the shelves 21-1 to 21-3. Even though documents are stored in these shelves, the screen 20 still permits the passage of air and light therethrough and further permits a user to be able to look through the screen 20.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A work station comprising:

a support frame;

a horizontally enlarged work surface supported by said support frame; and an article-supportive surround which projects vertically upwardly from and extends laterally along a rear edge of said work surface, said surround comprising a plurality of shelves which are vertically joined together one above the other, each said shelf being horizontally offset rearwardly relative to an adjacent said shelf in an ascending direction such that said plurality of shelves are vertically staggered, each of said shelves comprising an upward facing bottom wall which extends sidewardly along the length of said surround and a back wall extending upwardly from said bottom wall, an upper one of said shelves having said bottom wall thereof being connected to an upper section of said back wall of a lower one of said shelves.

2. A work station according to claim 1, wherein said work surface is inclined upwardly away from a front edge thereof toward said rear edge thereof.

3. A work station according to claim 2, wherein said front and rear edges of said work surface are arcuate so as to define a curved shape for said work surface.

4. A work station according to claim 1, wherein said surround comprises an upwardly extending frame which defines a shape thereof and a mesh-like screen which overlies said frame to define respective surfaces of said back walls of said plurality of shelves.

5. A work station according to claim 4, wherein said screen defines openings therein which permit the passage of air and light therethrough.

6. A work station according to claim 4, wherein each said bottom wall defines an upward opening trough-like channel for receiving articles therein.

7. A work station according to claim 4, wherein said open frame comprises a plurality of upwardly extending support members which are disposed in cantilevered relation with said work surface and project upwardly therefrom, said open frame further including a plurality of horizontal support members which extend sidewardly between said upright support members and are vertically spaced apart, said frame being open in the areas between said upright support members and said horizontal support members, said screen extending horizontally and vertically across said open areas to define said surfaces of said shelves.

8. A work station comprising:

a support frame;

a horizontally enlarged work surface supported on said support frame; and an article-supportive surround which extends upwardly from said work surface, said surround comprising a plurality of horizontally elongate shelves which are vertically joined together, said surround including an open frame defined by upright support members projecting upwardly from said work surface and horizontal support members which are vertically spaced apart and connected to said upright support members so as to define openings therebetween, said frame further comprising a mesh-like screen which is vertically and horizontally enlarged and overlies said open frame to define upward and forward facing surfaces of said plurality of shelves.

9. A work station according to claim 8, wherein each of said plurality of shelves comprises an upward facing bottom wall and a forward facing upright wall which are defined by said screen.

10. A work station according to claim 9, wherein said bottom wall of an upper one of said plurality of shelves is connected to an upper end of said upright wall of a lower one of said plurality of shelves such that said upper shelf extends upwardly above said lower shelf.

11. A work station according to claim 10, wherein said bottom wall of said upper shelf extends rearwardly away from said upright wall of said lower shelf such that said plurality of shelves are vertically staggered away from said work surface.

12. A work station according to claim 11, wherein said screen-has closely spaced openings therethrough.

13. A work station according to claim 9, wherein each one of said horizontal support members is spaced both horizontally and vertically away from an adjacent one of said horizontal support members, each adjacent pair of said horizontal support members defining opposite side edges of one of said bottom walls and said upright walls of said plurality of shelves.

14. A work station according to claim 13, wherein said is flexible and screen is woven through said horizontal support members such that each one of said adjacent pairs of said horizontal support members has a section of said screen extending therebetween, each of said sections defining a support surface for one of said bottom wall and said upright wall.

15. A work station according to claim 14, wherein said screen has closely, spaced openings therethrough.

16. A work station according to claim 1, wherein the back wall of at least one of said shelves is defined by a mesh-like screen having openings therethrough which permits passage of air and light therethrough.

17. A work station according to claim 16, wherein a said bottom wall defines an upwardly opening trough-like channel for receiving articles therein.

18. An article supportive surround comprising:

a frame;

a plurality of shelves disposed on said frame and being vertically joined together one above the other and horizontally offset rearwardly relative to each other such that said plurality of shelves are vertically staggered, each of said shelves including an upwardly facing bottom wall which extends sidewardly along the length of said surround and a back wall extending upwardly from said bottom wall, an upper one of said shelves having said bottom wall thereof connected to an upper section of said back wall of a lower one of said shelves;

said frame including a mounting arrangement adapted for mounting said surround so as to project upwardly from a rear edge of a horizontally enlarged work surface; and said back wall of at least one of said shelves being defined by a mesh-like screen having openings therethrough.

19. The article supportive surround according to claim 18, wherein at least one of said bottom walls is defined by an upwardly opening trough-like channel for receiving articles therein.

20. The article supportive surround according to claim 18, wherein said back wall of all of said shelves is defined by a mesh-like screen having openings therethrough.

* * * * *

UNITED STATES PATENT AND TRADEMARK OFFICE

CERTIFICATE OF CORRECTION

PATENT NO. : 5,908,002

DATED : June 1, 1999

INVENTOR(S) : Brian D. T. Alexander et al

It is certified that error appears in the above-identified patent and that said Letters Patent is hereby corrected as shown below:

Column 8, line 12; delete "open".

Column 8, line 15; delete "open".

Column 9, line 2; delete ",".

Signed and Sealed this

Twenty-first Day of December, 1999

*Attest:*

Q. TODD DICKINSON

*Attesting Officer*

*Acting Commissioner of Patents and Trademarks*